United States Patent [19]

Taylor-Smith

[11] 4,454,986

[45] Jun. 19, 1984

[54] RAILROAD SPIKE

[75] Inventor: Ernest J. Taylor-Smith, Vancouver, Canada

[73] Assignee: Koppers International Canada Ltd., Richmond, Canada

[21] Appl. No.: 215,229

[22] Filed: Dec. 11, 1980

[51] Int. Cl.[3] ..... E01B 9/10; E01B 21/04; E01B 29/24

[52] U.S. Cl. ..... 238/369; 238/294; 238/349; 411/78; 411/448

[58] Field of Search ..... 116/287; 226/81; 238/294, 349, 366, 369, 371; 261/113; 411/57, 75, 76, 78, 354, 446, 447, 448

[56] References Cited

U.S. PATENT DOCUMENTS

| | | | |
|---|---|---|---|
| 276,511 | 4/1883 | Wakeman, Jr. | 411/447 |
| 613,797 | 11/1898 | Dodson | 411/354 |
| 884,435 | 4/1908 | Walton | 238/371 X |
| 991,688 | 5/1911 | Begg | 411/354 X |
| 1,121,076 | 12/1914 | Dillon | 411/78 X |
| 1,249,161 | 12/1917 | Mathews | 238/349 |
| 1,249,191 | 12/1917 | Quigley | 226/81 X |
| 1,490,390 | 4/1924 | Hayles | 238/294 |
| 1,553,176 | 9/1925 | Kull | 238/294 |
| 1,608,916 | 11/1926 | Tunks | 238/294 X |
| 1,621,728 | 3/1927 | Jordan | 261/113 |
| 2,145,931 | 2/1939 | Hills | 116/287 |
| 2,154,931 | 4/1939 | Gailor | 238/349 X |
| 2,526,005 | 10/1950 | Carpenter | 238/349 |
| 2,690,876 | 10/1954 | Snyder | 238/349 |
| 3,378,200 | 4/1968 | McCormick | 238/349 |
| 3,429,505 | 2/1969 | Newton | 238/349 |
| 3,865,307 | 2/1975 | Schiro | 238/366 |

FOREIGN PATENT DOCUMENTS

| | | | |
|---|---|---|---|
| 51797 | 5/1890 | Fed. Rep. of Germany | 238/369 |
| 19022 | of 1915 | United Kingdom | 411/354 |

*Primary Examiner*—Bruce H. Stoner, Jr.
*Assistant Examiner*—Howard Beltran
*Attorney, Agent, or Firm*—Fulwider, Patton, Rieber, Lee & Utecht

[57] ABSTRACT

An improved rail fastening assembly composed of a new rail spike and a contact plate member for maintaining a rail in the preset contact with a cross-tie. The assembly of the present invention maintains rail gauge in spite of long and heavy trains.

4 Claims, 4 Drawing Figures

Fig. 1.
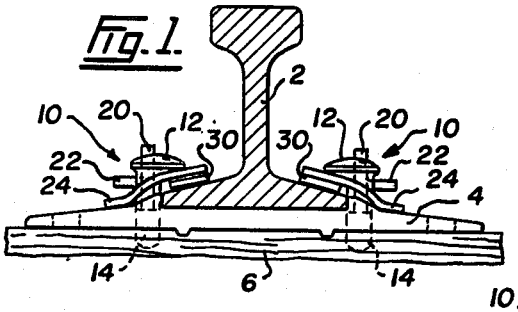
Fig. 3.
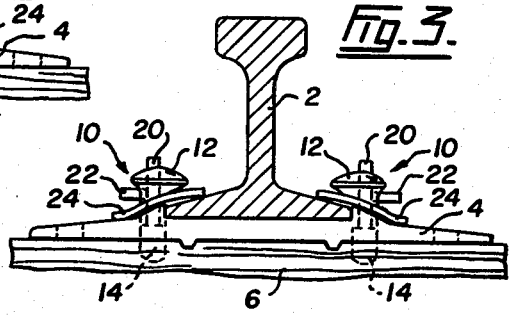
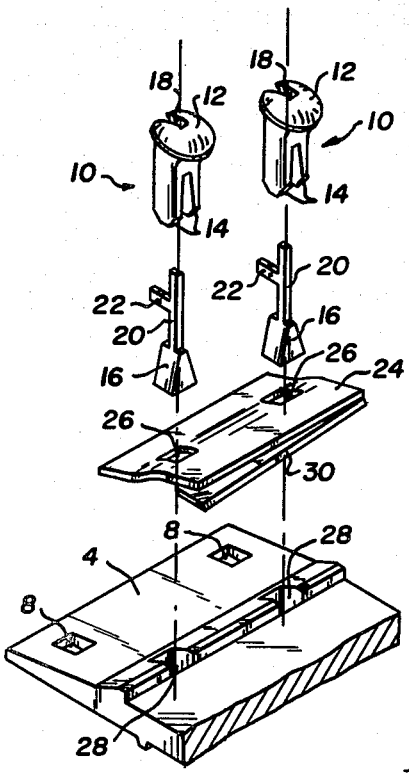
Fig. 2.
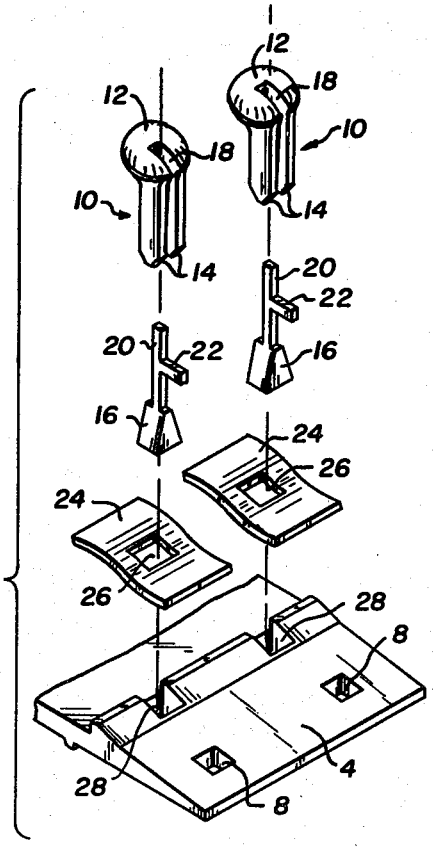
Fig. 4.

RAILROAD SPIKE

FIELD OF THE INVENTION

This invention relates to a rail fastener system for securing a railroad rail to a cross-tie and more particularly to an improved rail spike and rail contact plate for maintaining rail gauge.

DESCRIPTION OF THE PRIOR ART

A railroad track comprises rails spaced at a predetermined gauge located on a tie plate that is in turn located on a tie. For many years the principal method of locating the tie plate on the tie has been the use of spikes. The spike is typically a member of rectangular cross section having an offset head that is driven through a hole in the tie plate to engage in the wooden tie. The offset head contacts the rail so that the spike not only locates the tie plate on the tie but also the rail on the tie plate.

The system has worked reasonably well for many years although there is the disadvantage that it has always been labour intensive. That is it has never provided an extremely stable location of the track and it has always been necessary to use railroad gangs to maintain the track when the spike system is used.

As a result of this disadvantage there have been substantial numbers of attempts to improve the traditional system of a simple spike. Examples of attempts at improvements known to applicant include U.S. Pat. Nos. 1,621,728 to Crippen; 1,553,176 to Kul; 1,608,773 to Crippen; 1,249,161 to Mathews; 2,154,931 to Gailor; 2,690,876 to Snider; 3,378,200 to McCormick; 2,526,005 to Carpenter and 3,865,307 to Shiro.

Of the above patents Shiro discloses a spike used in relatively conventional manner. The spike has an elongated shank and an offset head portion. The shank terminates in a pointed solid end, and a bore extends longitudinally through the body and terminates at the bottom in an inverted Y with the ends of the Y opening outwardly of the pointed sloping side surface of the shank. There are longitudinally extending slots extending through the head portion. There is a locking pin of a diameter less than the diameter of the bore and having longitudinal flanges to align and orient the locking pin in the bore when inserted axially in the bore through the head portion. The bottom of the locking pin has longitudinal splits into opposed members spread outwardly through the limbs of the Y in the spike. The spike can be released only by pulling the spike and the locking pin.

Carpenter shows a clamping plate that can be bolted to locate a rail into place. McCormick is also of interest for its disclosure of a clamping plate. Snyder shows a clamping plate used in conjunction with a shoulder spike. Gailor shows a clamping member including lugs of a generally T-shaped configuration. Matthews shows a clamping plate that is attached directly to the rail and Crippen in U.S. Pat. No. 1,608,773 shows a split spike holder. The object of the invention in Crippen is to ensure that no changes are required in the standard spike. Kull shows a pin formed integral with the spike to spread as a locking mechanism when the spike is driven home. Crippen in U.S. Pat. No. 1,061,768 shows an arrangement similar to the earlier Crippen patent and the use of a tab or member to lock over the spike after the spike has been driven.

However, none of the systems disclosed and claimed in these patents has found general acceptance.

There is an increasing tendency to use very long and very heavy trains on modern railroads. These long, heavy trains accentuate the problem. The spikes in contact with the rail pull out of line due to the sustained pressures and rhythms.

It has been shown that where ordinary spikes are driven into the gauge holes in a tie plate and are not in contact with the rail then the gauge can be maintained more easily. Although many of the systems described and claimed in the above patents make use of this fact the patented systems have failed to obtain commercial application because they are not simple and not economical to manufacture. They often feature too many parts. They cannot be installed or removed by untrained personnel, with or without mechanical equipment. Furthermore some of the systems are unable to withstand corrosive materials and adverse weather conditions and require adaptation to existing tie plates, which clearly is an uneconomic factor. Others need to be used with specific tie plates but a railroad location system must be able to be used on all tie plates (that is four, six and eight hole tie plates) if it is to be accepted.

In addition to avoiding the above disadvantages an acceptable system must be able to prevent rollover of the rails but allow the rail to flex vertically under tension while still holding the rail in lateral position. It is also important that the system be capable of visual inspection for breakage or faults.

SUMMARY OF THE INVENTION

It is an object of the present invention to provide an acceptable, efficient system that avoids the above disadvantages.

Accordingly, in a first aspect, the present invention is a railroad spike comprising a head; spaced limbs extending from the head; means to spread said limbs; and means to maintain said limbs spread.

In a preferred embodiment the means to spread the limbs is a wedge. Also in a preferred embodiment there is a passageway at the back of the head extending to a point between the limbs; a rod extends from one end of the wedge and is adapted to occupy the passageway.

In a further aspect there is a contact plate having a hole adapted to receive the spike and to align with an opening in a railroad tie plate. When in use the spike acts to exert pressure on the contact plate and, thus, downwardly on the rail.

Further the above limb desirably has a lug extending outwardly, that is away from the rail when the spike is in its useful position on a rail, to act downwardly against the plate. This lug comprises a means of maintaining the limbs spread.

In a further aspect the invention is in a railroad locating system for attaching a rail to a railroad tie plate, the tie plate having a central area to receive a rail and openings, each to receive a spike, at the side of said central area and is the improvement comprising: a contact plate formed with at least one hole to align with an opening in a tie plate; a spike; a head formed in the spike to abut and exert a downward force on the locating plate; limbs extending from the head; a spreader positionable between the limbs of the spikes to spread the limbs apart; and means to lock the spreader in a desired position.

In yet a further aspect the invention is a section of railroad track comprising a plurality of spaced ties; tie plates attached to said ties; rails positioned on said tie plates; a rail location system comprising pressure plates contacting the tie plates and the rails; an opening in each pressure plate; a spike having a head contacting each pressure plate; spaced limbs extending through said opening in the pressure plate and into a tie plate; a wedge extending upwardly to spread said limbs and maintain the limbs in frictional engagement with a tie plate; and means to maintain said wedge in position.

BRIEF DESCRIPTION OF THE DRAWINGS

Aspects of the invention are illustrated, merely by way of example, in the accompanying drawings in which:

FIG. 1 is a section through a rail located using a system of the present invention;

FIG. 2 is an exploded, partial view of the embodiment of FIG. 1;

FIG. 3 is a section through a rail located by a further embodiment of the invention; and FIG. 4 is an exploded partial view of the embodiment of FIG. 3.

DESCRIPTION OF THE PREFERRED EMBODIMENTS

The drawings illustrate a rail 2 (FIGS. 1 and 3) located on a tie plate 4 located on a tie 6. The tie plate 4 may be located on the tie by conventional spikes (not shown) driven through the holes 8.

As can be seen particularly in FIGS. 2 and 4, a railroad spike 10 according to the present invention comprises a head 12. There are spaced limbs 14 extending from the head 12. There are means to spread the limbs which, as illustrated in FIGS. 2 and 4, comprise wedges 16. There are means to maintain the limbs 14 spread, that is to maintain the wedges 16 in a predetermined position. To achieve this there is a passageway 18 extending through the head 12 to a point between the limbs 14. An upstanding rod 20 occupies the passageway 18. There is a lug 22 on each rod 20. The arrangement is such that the spike 10 is driven onto the wedge 16 to achieve a proper degree of frictional engagement, that is the limbs 14 are maintained in a spread position so that the spike 10 cannot be inadvertently withdrawn. The upstanding rod 20 and thus the wedge 16, are then held in position by abutment of the lug 22 on the upper surface of a contact plate 24.

Each contact plate 24 has a hole 26 adapted to receive the spike 10 and to align with openings 28 (or gauge holes) in the tie plate 4. Spike 10, in being driven downwardly, exerts pressure on the contact plate 24 as illustrated in FIG. 1.

In the aspect of the invention illustrated in FIGS. 1 and 2 the contact plate 24 is adapted to receive two spikes 10. There is a spring member 30 attached to one end of the plate 24 to exert pressure on a rail 2 when pressure is exerted on the plate 24. This system provides a more stable location of the rails and is used on curves where the force on a rail as the train passes over is greater. Furthermore the spring 30 provides some resilience.

The system illustrated in FIGS. 3 and 4 is generally used on straight track. It can be sufficient, in these circumstances, to use one contact plate 24 and one spike 10 on each side of the rail 2, even though the system shown in FIGS. 3 and 4 shows two separate plates 24 and two spikes 10 on the right.

To install the spike shown in FIGS. 1 and 2 the tie plate 4 is applied to the tie 6 and positioned for gauge in accordance with standard procedures. It is then secured to the tie 6 by applying only two standard spikes per plate in openings 8, one on each side of the plate 4.

After placing the rail 2 on the tie plate 4, plate 24, with springs 30 attached, is positioned over plate 4 so that the openings 26 in plate 24 are aligned with openings 28 in plate 4. This may be determined visually or by use of a locating pin.

A spike 10, complete with wedge 16, is then inserted in the aligned openings 26 and 28 with wedge 16 inserted first and with the lug 22 pointing away from the rail. Spike 10 is driven home until the top of lug 22 prevents the wedge 16 sinking further. The spring 30 fastened to plate 24 is slightly compressed during this due to the pressure of head 12 of spike 10.

In the embodiment of FIGS. 3 and 4, that is where spring 30 is not present, plate 24 is fitted in an identical manner again ensuring that opening 26 is aligned with opening 28. The angle of the plate 24 without spring 30 is such that the plate 24 comes into direct contact with the rail without use of an intervening spring 30.

To remove the spike it is necessary to shear the lug 22, tap the rod 20 in a downward position while using a spike puller to remove the spike 10. It is almost impossible to remove without first shearing the lug 22 and tapping the rod 20. The lug 22 holds the wedge 16 in position thereof allowing the wedge 16 to lock the limbs 14 of the spike immediately under the opening 28 in the tie plate 4. Thus by shearing the lug 22 and depressing the rod 20 the spike 10 is released.

I claim:

1. A railroad spike comprising a head;

a contact plate having a hole adapted to receive said spike and to align with an opening in a railroad tie plate, the spike acting, when in use, to exert pressure on the contact plate;

spaced limbs extending from the head;

a wedge positionable between the limbs to spread said limbs and able to pass through the hole in the contact plate;

a passageway through the head to a point between the limbs and a rod extending from one end of the wedge and adapted to occupy said passageway;

a lug extending from said rod and positioned to be trapped between the head and the contact plate when the spike is in its useful position;

whereby driving of the spike downwardly through the contact plate into a tie plate of a railroad drives the limbs over the wedge to spread the limbs and to force the lug into contact with the contact plate, the spreading of the limbs acting to prevent the spike moving upwardly and the contact of the lug with the contact plate acting to prevent the wedge moving downwardly and whereby removal of the spike can only be achieved by removing the lugs and moving the rod and wedge downwardly while pulling the head of the spike upwardly.

2. A spike as claimed in claim 1 in which the contact plate is adapted to receive two spikes;

a spring member attached to one end of the plate to exert pressure on a rail when pressure is exerted on the plate.

3. In a railroad locating system for attaching a rail to a railroad tie plate, the tie plate having a central area to receive a rail and openings, each to receive a spike, at the side of said central area the improvement comprising:

a contact plate formed with at least one hole to align with an opening in a tie plate;

a spike;

a head formed on the spike to abut and exert a downward force on the contact plate;

spaced limbs extending from the head;

a wedge positioned between the limbs to spread the limbs and able to pass through at least one hole in the contact plate;

a passageway through the head to a point between the limbs;

a rod extending from one end of said wedge and positioned in the passageway including a lug transversely extending from said rod;

whereby driving the spike downwardly, through the at least one hole in a contact plate into a tie plate, drives the limbs over the wedge to spread the limbs and to force the lug into contact with the contact plate, the spreading of the limbs acting to prevent the spike moving upwardly and the contact of the lug with the contact plate acting to prevent the wedge moving downwardly and whereby removal of the spike is achieved only by removing the lug and moving the rod and wedge downwardly while pulling the head upwardly.

4. In a section of a railroad track comprising a plurality of spaced ties;

tie plates attached to said tie;

rails positioned on said tie plates;

the improvement comprising a rail location system comprising:

pressure plates contacting the tie plates and the rails;

an opening in each pressure plate;

a spike having a head contacting each pressure plate;

spaced limbs extending through said opening in the pressure plate and into a tie plate;

a wedge extending upwardly to spread said limbs and maintain the limbs in friction engagement with a tie plate;

a passageway extending from the top of the head of each spike to a point between the limbs of each spike;

a rod extending from the wedge into the passageway;

a lug extending from each rod and trapped between a head of a spike and a pressure plate to maintain the wedge in position;

whereby the limbs are spread over the wedge and the lug is in contact with a contact plate, the spreading of the limbs acting to prevent the spike being moved upwardly and the contact of the lug with the contact plate acting to prevent the wedge moving downwardly, removal of the spike being possible only by removing the lug, moving the rod and wedge downwardly while pulling the head of the spike upwardly.

* * * * *